US005855701A

United States Patent [19]

Bonnevie

[11] Patent Number: 5,855,701

[45] Date of Patent: Jan. 5, 1999

[54] METHOD OF MANUFACTURE HIGH CARBON CONTENT STEEL

[75] Inventor: Michel Bonnevie, Bovesse, Belgium

[73] Assignees: Magotteaux International S.A., Vaux-sous-Chevremont; Amic Industries Limited, Scaw Metals Division, Germiston, both of South Africa

[21] Appl. No.: 727,419

[22] PCT Filed: Apr. 14, 1995

[86] PCT No.: PCT/BE95/00036

§ 371 Date: Mar. 27, 1997

§ 102(e) Date: Mar. 27, 1997

[87] PCT Pub. No.: WO95/28506

PCT Pub. Date: Oct. 26, 1995

[30] Foreign Application Priority Data

Apr. 18, 1994 [BE] Belgium ..... 9400390

[51] Int. Cl.[6] ..... C21D 9/36

[52] U.S. Cl. ..... 148/545; 148/548

[58] Field of Search ..... 420/100, 9; 148/321, 148/333, 545, 548, 660

[56] References Cited

FOREIGN PATENT DOCUMENTS

| | | |
|---|---|---|
| 0014655 | 8/1980 | European Pat. Off. . |
| 0120748 | 10/1984 | European Pat. Off. . |
| 2006824 | 5/1979 | United Kingdom . |
| 2024860 | 1/1980 | United Kingdom . |

OTHER PUBLICATIONS

Patent Abstracts of Japan, vol. 6, No. 78, May 15, 1982, JP57–13150.

Patent Abstracts of Japan, vol. 14, No. 77, Feb. 14, 1990, JP1294821.

Derwent Publications Ltd., Database WPI, Week 7814, Feb. 23, 1978, JP53019916.

*Primary Examiner*—Deborah Yee

*Attorney, Agent, or Firm*—Jacobson, Price, Holman & Stern, PLLC

[57] ABSTRACT

Alloyed steel with high carbon content having a composition, expressed in percentage weight: carbon from 1.1 to 2.0%, manganese from 0.5 to 3.5%, chromium from 1.0 to 4.0%, silicon from 0.6 to 1.2%, the remainder being iron with the usual impurity content, such that it provides a metallographic structure mainly of non-equilibrium fine pearlite and that its hardness is between 47 Rc and 54 Rc.

5 Claims, 1 Drawing Sheet

METHOD OF MANUFACTURE HIGH CARBON CONTENT STEEL

OBJECT OF THE INVENTION

The present invention relates to steel alloys with high carbon content, particularly for use in making wearing parts, more particularly for grinding media such as grinding balls.

STATE OF THE ART

In the mining industry, it is necessary to release valuable minerals from the rock in which they are embedded taking into account their concentration and extraction.

For such release, the mineral must be finely ground and crushed.

Considering only the grinding stage, it is estimated that 750,000 to 1 million tons of grinding media are annually used worldwide, in the form of spherical balls or truncated cone-shaped or cylindrical cylpebs. Grinding media commonly used:

1. Low alloyed martensitic steels (0.7–1% carbon, alloy elements less than 1%) formed by rolling or by forging followed by heat-treatment to obtain a surface hardness of 60–65 Rc.
2. Martensitic cast-iron alloyed with chrome (1.7–3.5% carbon, 9–30% chrome) formed by casting and heat-treatment to obtain a hardness of 60–68 Rc in all sections.
3. Low alloyed pearlitic white iron (3–4.2% carbon, alloy elements less than 2%), untreated and with a hardness of 45–55 Rc obtained by casting.

All of the present solutions have their own disadvantages:

for the forged martensitic steels, it is the investment costs for the forging or rolling machines and the heat-treatment apparatus which raises energy consumption.

with regard to the chromium alloyed irons, the supplementary costs are linked with the alloy elements (mainly the chrome) and the heat-treatment.

finally for the low alloyed pearlitic white iron, the manufacturing costs are generally fairly low but their wear-resistance properties are not as good as the other solutions. Further, usually only grinding media of less than 60 mm are industrially produced.

Overall, in the case of minerals where the rock is very abrasive (e.g. gold, copper, . . . ), the present solutions do not completely satisfy the users as the costs of the products and materials subject to wear (grinding balls and other castings), still contributes greatly towards the cost of production of the valuable metals.

AIM OF THE INVENTION

The object of the invention is to provide steels having improved properties and, particularly, to overcome the problems and disadvantages of the state of the art solutions for wear parts (particularly grinding media). The composition, casting and cooling conditions after casting of the invention allow wear resistance, especially in very abrasive conditions, which is comparable to forged steels and chrome cast-irons but with less cost and superior to pearlitic cast-irons (but with a comparable cost).

Other objects and disadvantages of the present invention will become apparent from reading the following description of the characteristics of the invention and preferred embodiments thereof.

CHARACTERISTIC ELEMENTS OF THE INVENTION

Figure 1:
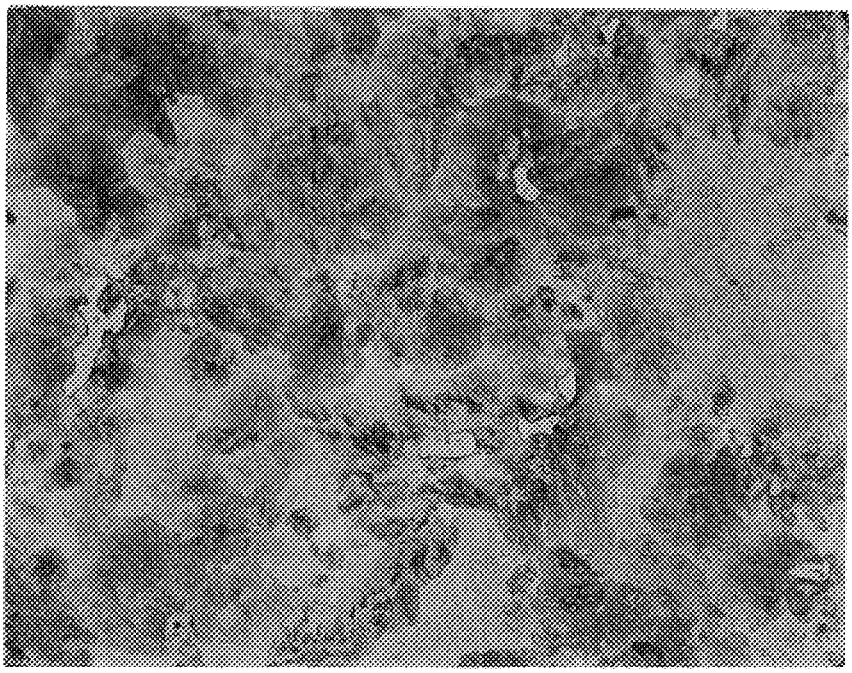
FIGS. 1 and 2 are micrographs showing structures of the steels obtained according to the invention.

The invention provides an alloy steel of high carbon content and the process of production of grinding media made of the alloyed steel characterized in that their composition complies with the following composition expressed in % weight:

| | |
|---|---|
| carbon | from 1.1 to 2.0% |
| manganese | from 0.5 to 3.5% |
| chromium | from 1.0 to 4.0% |
| silicon | from 0.6 to 1.2% |

The remainder being made up of iron with the usual impurity content, such that they provide a metallographic structure mainly comprising non-equilibrium fine pearlite, with a hardness of between 47 Rc and 54 Rc.

Preferably, for grinding media, particularly grinding balls, the carbon content is between 1.2 and 2.0% preferably between 1.3 and 1.7% to achieve an optimal wear resistance while maintaining shock resistance.

In practice, it is advisable to select the manganese content as a function of the diameter of the grinding ball and the rate of cooling to obtain the fine pearlite structure.

The following compositions are interesting with regard to the resistance to wear for grinding media, particularly grinding balls of 100 mm diameter.

| | |
|---|---|
| carbon | in the order of 1.5% |
| manganese | in the order of 1.5 to 3.0% |
| chromium | in the order of 3.0% |
| silicon | in the order of 0.8% |

For grinding balls, of 70 mm diameter, an alloy composition of:

| | |
|---|---|
| carbon | in the order of 1.5% |
| manganese | in the order of 0.8 to 1.5% |
| chromium | in the order of 3.0% |
| silicon | in the order of 0.8% |

has proven to be particularly advantageous.

The heat-treatment used, is selected to minimize the quantities of cementite, martensite, austenite and coarse pearlite which may appear in the structure of the steel.

According to the invention, the aforementioned steels are subjected, after casting, to a heat-treatment stage comprising cooling from a temperature above 900° C. to a temperature of about 500° C. at an average rate of cooling between 0.3 and 1.9° C./s to provide the steel with said microstructure consisting mainly of non-equilibrium fine pearlite with a hardness between 47 and 54 Rc.

The casting directly shapes the wear parts and particularly the grinding media and can be carried out by any known casting technique.

The pearlite structure is obtained by extraction of the still-hot piece out of the casting mould and by adapting the chemical composition to the mass of the piece and the rate of cooling following extraction from the mould.

The invention will now be described in more detail with reference to the preferred embodiments, given by way of illustration without limitation.

In the examples, the percentages are expressed in percentage weight.

EXAMPLES 1 TO 4

In all the examples, a steel composition of 1.5% carbon, 3% chrome and 0.8% silicon, the remainder being iron with the usual impurity content, is implemented. The specific manganese and chromium contents expressed in percentage weight are given for the different examples in table 1 for different sizes of balls.

TABLE 1

| Experiment no. | Ball ø (mm) | % Mn | % Cr |
|---|---|---|---|
| 1 | 100 | 3 | 3 |
| 2 | 100 | 1.9 | 3 |
| 3 | 70 | 1.5 | 3 |
| 4 | 70 | 0.8 | 3 |

After complete solidification, the piece is extracted from its mould at the highest possible temperature which is compatible with easy manipulation and preferably above 900° C.

The piece is then cooled in a homogeneous manner at a rate defined as a function of its mass.

This controlled cooling is maintained until a temperature of 500° C. after which the cooling is immaterial.

The average of cooling expressed in C./s between the temperatures of 1000° C. and 500° C. is given in table 2 for the two examples mentioned above.

TABLE 2

| Experiment No. | Ball ø (mm) | Average Rate of Cooling |
|---|---|---|
| 1 | 100 | 1.15° C./s |
| 2 | 100 | 1.30° C./s |
| 3 | 70 | 1.50° C./s |
| 4 | 70 | 1.65° C./s |

The main advantages of this heat-treatment are that it enables the fine pearlite structure to be achieved most easily. Also, use can be made of the residual heat of the piece after casting, thus reducing production costs.

Figure 2:
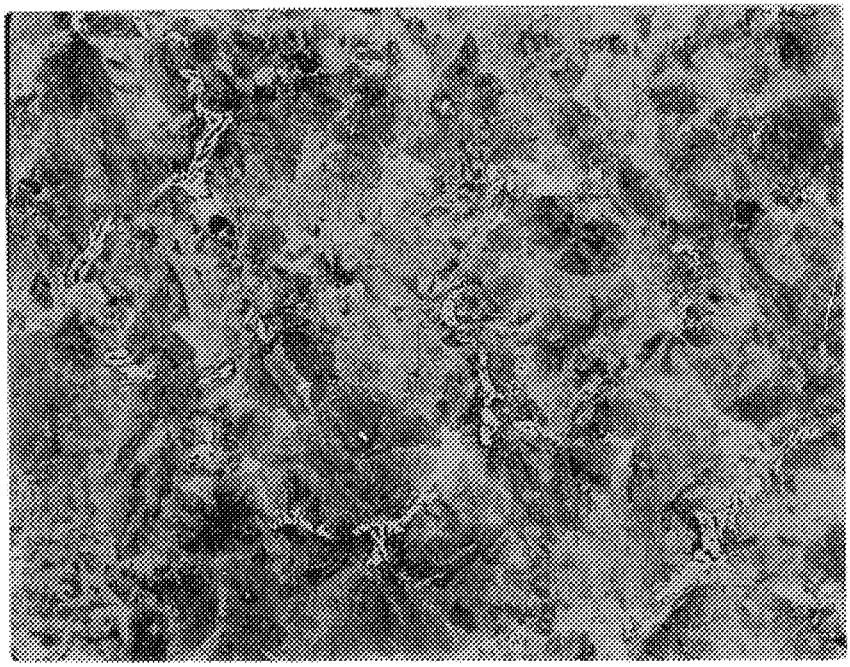

The micrographs of FIGS. 1 and 2 show the structure of steels obtained according to the invention.

FIG. 1 magnified 400 times, shows the micrograph of a 100 mm ball whose chemical composition, expressed in percentage weight is:

1.5% carbon 1.9% manganese 3.0% chromium 0.8% silicon

After extraction from the mould, this casting was uniformly cooled from a temperature of 1100° C. to ambient temperature at a rate of 1.30° C./s.

The measured Rockwell hardness is 51 Rc. The structure consists of fine pearlite, 8–10% cementine and at least 5–7% martensite.

FIG. 2 magnified 400 times, shows the micrograph of a 70 mm ball having the following chemical composition, expressed in % weight:

1.5% carbon 1.5% manganese 3.0% chromium 0.8% silicon

This piece was uniformly cooled after extraction from a temperature of 1100° C. at a cooling rate of 1.50° C./s to ambient temperature.

The measured Rockwell hardness is 52 Rc. The structure comprises fine pearlite, 5–7% martensite.

The grinding media or balls whose micrographs are shown in FIGS. 1 and 2 have been subjected to wear tests to check their behavior and their properties in an industrial environment.

The wear resistance of the alloy of the invention has thus been evaluated by the technique of marked balls trials. This technique comprises inserting a predetermined quantity of balls made with the alloy of the invention into an industrial grinding mill. First, the balls are sorted by weight and identified by bore holes, together with balls of the same weight, made of one or different alloys known from the state of the art. After a set period of operation, the mill is stopped and the marked balls are recovered. The balls are weighed and the difference in weight allows the performance of the different alloys tested to be compared. These checks are repeated several times to obtain a statistically valid value.

A first test was carried out in a mill on a particularly abrasive mineral containing more than 70% quartz. The 100 mm diameter balls were tested each week for five weeks. The reference ball of martensitic high chrome white iron wore down from an initial weight of 4,600 kg to 2,800 kg. The relative resistance to wear of the different alloys are summarized below:

12% Chromium martensitic white iron of 64 Rc 1.00×
steel of the invention of 51 RC 0.98×

Similar tests were carried out in other mills where the treated mineral was equally very abrasive, but where the conditions of impact compared to the conditions of operation of the mill were different.

The results obtained with the balls made of the alloy of the invention were very close (0.9 to 1.1 times better) to those obtained by the high chromium white iron.

These performances of resistance to abrasive wear of the pearlitic alloy according to the invention allow the user's costs associated with grinding to be noticeably reduced.

Indeed, the simplification of the manufacturing processes, the reduction in installation and operating costs and the reduction in alloy elements in comparison with chromium iron provides a more economic manufacture.

I claim:

1. Process for the production of grinding media, made of alloyed steel of the composition, (expressed in percentage weight):

| | |
|---|---|
| carbon | from 1.1 to 2.0% |
| manganese | from 0.5 to 3.5% |
| chromium | from 1.0 to 4.0% |
| silicon | from 0.6 to 1.2% |

the remainder being iron with the usual impurity content, wherein after casting, they are subjected to a stage consisting of cooling from a temperature above 900° C. to a temperature of above 500° C. at a cooling rate of between 0.30 and 1.90° C./s, to provide a metallographic structure mainly of non-equilibrium fine pearlite and having a hardness between 47 Rc and 54 Rc.

2. Process according to claim 1, wherein the carbon content of the grinding media is between 1.2 and 2.0%.

3. Process according to claim 1, wherein the carbon content of the grinding media is between 1.3 and 1.7%.

4. Process according to claim 1, wherein the carbon content of the grinding media is of the order of 1.5%.

5. Process according to claim 1, wherein the pearlitic structure is obtained by extracting of the still-hot piece from the casting mould and by adapting the chemical composition to the mass of the piece and the rate of cooling following extraction from the mould.

* * * * *